US005595029A

United States Patent [19]

Revoir et al.

[11] Patent Number: 5,595,029

[45] Date of Patent: Jan. 21, 1997

[54] MOLDED TOMBSTONE/MONUMENT

[76] Inventors: Melvin H. Revoir, 835 Hayner Dr., Petoskey, Mich. 49770; Gregory L. Revoir, 10346 Burnett, Charlevoix, Mich. 49720

[21] Appl. No.: 254,191

[22] Filed: Jun. 6, 1994

Related U.S. Application Data

[63] Continuation-in-part of Ser. No. 88,437, Jul. 7, 1993, abandoned.

[51] Int. Cl.[6] ..... E01F 9/011

[52] U.S. Cl. ..... 52/103; 52/104; 40/124.5

[58] Field of Search ..... 52/103, 104, 309.1, 52/309.9; 40/124.5, 606; 428/13

[56] References Cited

U.S. PATENT DOCUMENTS

| | | | |
|---|---|---|---|
| D. 122,656 | 9/1940 | Adams . | |
| 171,881 | 1/1876 | Stinson | 52/104 |
| D. 303,033 | 8/1989 | Powell et al. | D99/17 |
| 582,470 | 5/1897 | Hammond | 52/104 |
| 604,354 | 5/1898 | Ford . | |
| 833,212 | 10/1906 | Howard . | |
| 1,158,932 | 11/1915 | Kohl | 52/295 |
| 1,365,635 | 1/1921 | Tyree . | |
| 2,013,377 | 9/1935 | Debs | 40/124.5 |
| 2,046,594 | 7/1936 | Walton | 40/124.5 |
| 2,148,660 | 2/1939 | Sweeney | 40/124.5 |
| 2,240,016 | 4/1941 | Pinney | 52/295 |
| 2,358,009 | 9/1944 | Hogsten et al. | 40/124.5 |
| 2,587,724 | 4/1952 | Henderson | 52/295 |
| 2,623,616 | 12/1952 | Oartlin | 52/295 |
| 2,724,261 | 11/1955 | Rensaa | 52/295 |
| 2,774,162 | 12/1956 | Porter | 40/124.5 |
| 2,802,766 | 8/1957 | Leverenz | 264/46.6 |
| 2,886,963 | 5/1959 | Bergmann | 52/103 |
| 3,091,946 | 6/1963 | Kesling | 264/46.6 |
| 3,310,918 | 6/1967 | Taylor, Jr. | 52/309.1 X |
| 3,533,180 | 10/1970 | Kalina | 40/124.5 |
| 3,758,999 | 9/1973 | Matvey | 52/103 |
| 3,857,214 | 12/1974 | Hedges | 52/103 |
| 4,009,547 | 3/1977 | Hood | 52/294 |
| 4,054,000 | 10/1977 | Lisle | 52/105 |
| 4,058,940 | 11/1977 | McBrayer | 52/104 |
| 4,202,144 | 5/1980 | Patterson | 52/103 |
| 4,304,076 | 12/1981 | Splendora | 52/104 |
| 4,428,168 | 1/1984 | Tomer | 52/104 |
| 4,550,537 | 11/1985 | Smith | 52/103 |

FOREIGN PATENT DOCUMENTS

| | | | |
|---|---|---|---|
| 2210080 | 6/1989 | United Kingdom | 52/104 |

*Primary Examiner*—Creighton Smith
*Attorney, Agent, or Firm*—Van Dyke, Gardner, Linn & Burkhart, LLP

[57] ABSTRACT

A molded tombstone or monument preferably formed of moldable polymeric material preferably having granite affect fillers and a textured surface providing the appearance of natural cut granite. The tombstone/monument is a solid, one-piece body having a base and an upright display area extending upwardly from the base and including an inscription area. The inscription area may include engraved indicia or separately formed indicia secured thereto by securing members. The tombstone/monument is secured in the ground using anchors which are secured to apertures provided in the bottom of the tombstone such that they are concealed from view. Alternately, the monument is secured to a concrete slab.

29 Claims, 10 Drawing Sheets

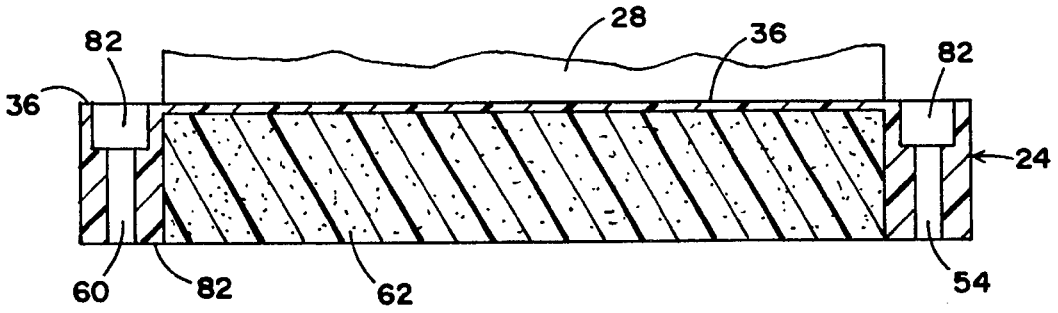
FIG. 7
FIG. 8
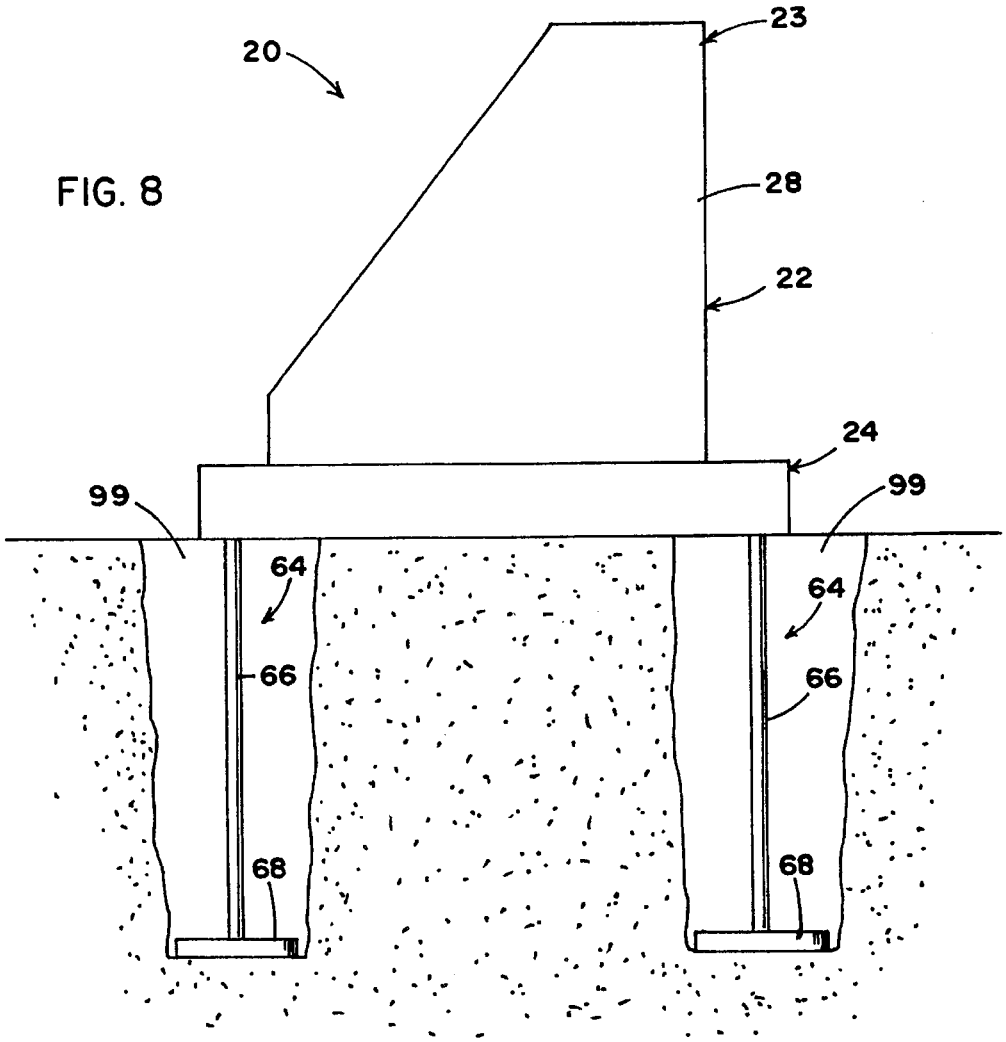

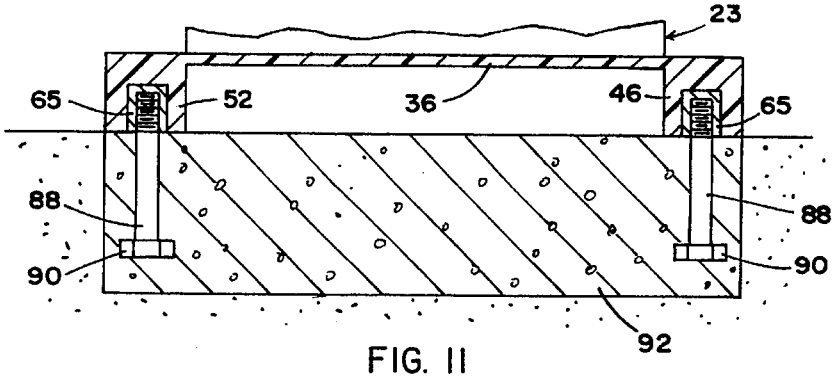
FIG. 11
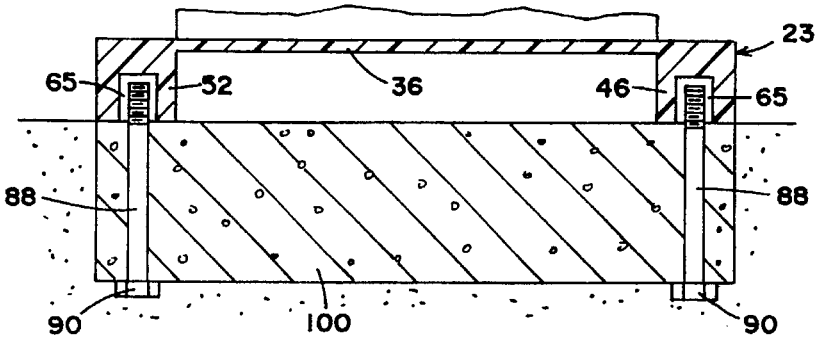
FIG. 12
FIG. 13
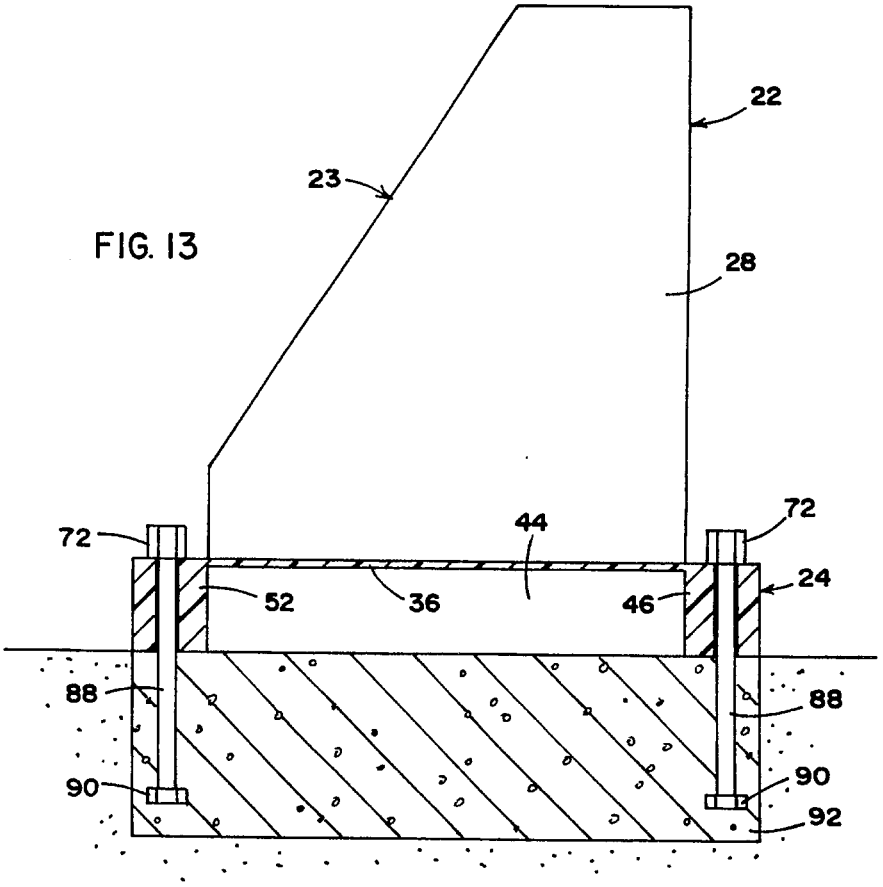

MOLDED TOMBSTONE/MONUMENT

CROSS-REFERENCE TO RELATED APPLICATION

This application is a continuation-in-part of U.S. patent application Ser. No. 08/088,437, filed Jul. 7, 1993, now abandoned.

BACKGROUND OF THE INVENTION

The present invention relates to tombstones and monuments, and more particularly to tombstones and monuments manufactured from an organic polymer, and anchoring systems for such tombstones.

Traditional tombstones are manufactured of granite or marble. These stone monuments are costly to the consumer for a variety of reasons. As a result, some people cannot purchase a tombstone of the size and shape that they desire, and in some cases, cannot afford to purchase a monument at all. Thus, the high cost of stone monuments impedes a descendant's survivors' ability to adequately mark the decedent's burial site.

One factor which contributes significantly to the high cost of stone monuments is their weight. These heavy monuments are difficult to transport. The difficulty exists both in transporting stones from a mine to the monument company, as well as in transporting tombstones from the tombstone company to a cemetery. The trucks utilized to haul stone monuments are costly and may carry only a limited number of these monuments due to the weight of the monuments. Trucks which carry a large number of stone monuments are also harmful to the roads on which they travel because of the great weight of the monument laden truck. The limited number of monuments that a truck can carry increases the shipping costs of these monuments.

Installation is also difficult and costly due to the weight of stone monuments. Heavy equipment must be used to lift the monuments from a truck to a burial site. Additionally, large concrete foundations may be required to support a heavy monument so that it does not settle into an unstable, leaning position.

Another problem with traditional monuments is that they are constructed from mined material. Mining is costly and produces dust and other pollutants which are difficult to control. Additionally, mines are unattractive to residents of neighboring residential areas.

Another disadvantage of stone monuments is the large time period required for a manufacturer to deliver the engraved marker. This large time period is partially a result of the time necessary to manufacture the monument from stone and write an inscription into the stone. Tombstones may take several months or more to manufacture and ship to a burial site. Furthermore, if an error is made while inscribing a monument, the engraver must begin again. This adds significant expense since the tombstone is ruined if the inscription is wrong.

In addition, previously known stone or granite monuments are normally made in two pieces, including a monument portion where the decedent's name or other inscription is normally placed, as well as a separate base portion on which the monument is supported. At the cemetery, these two pieces must be bonded or secured together. However, after lengthy exposure to the weather, normal settling of the ground and the like, these two portions often separate, resulting in the necessity and cost of rebonding or reattachment to maintain the stone monument in appropriate condition.

Further, attempts have been made to avoid various of the above problems by using synthetic or manufactured monuments. Some synthetic monuments use a hollow, plastic shell and some having such a hollow shell are filled with cement or other heavy materials. If filled with cement, such filling was required at the cemetery, requiring caretakers to build forms to exacting specifications matching the shell, mixing and pouring of the cement, followed by lengthy time periods to allow the cement to set up. Thereafter, the form would be removed, the monument set upright and the outer shell slipped over the formed cement and fastened with screws which required the drilling of holes in the shell and in the cement. Optionally, the hollow shell could be turned upsidedown and filled with cement which, after set up, could be returned to the upright position for placement. In either event, these methods proved time consuming, costly, and less than adequately weather resistant since the hollow shells filled with cement would form moisture at the interface between the plastic shell and cement. Such moisture would freeze in lower temperatures resulting in cracking and degradation of the monument.

In addition, many of the prior known synthetic monuments had an artificial appearance which tended to show scratches and other imperfections and reduce the desirability of the monument from an aesthetic standpoint.

Accordingly, a tombstone or monument was desired which is lightweight and easy to manufacture on a rapid and repeatable basis, but has the appearance, durability and secure mounting of traditional stone or granite monuments. Although a variety of tombstones have been developed which are manufactured in a manner which overcomes some of the disadvantages of traditional stone monuments noted above, known alternatives do not adequately solve the above-noted problems. Known alternatives to stone monuments do not have sufficient permanence, and do not adequately resemble stone monuments. Additionally, the mounting method for securing these alternatives are difficult and costly to implement.

SUMMARY OF THE INVENTION

The present invention provides an improved tombstone or monument including a combination of features which differ from those found in prior known tombstones or monuments, and which combine synergistically to provide a monument which is lightweight, durable, and both easier and more cost efficient to install than those used previously.

In one form, the tombstone/monument according to the invention includes a molded, solid body preferably formed from a moldable polymeric material and having an outer inscription area on an exterior surface, a base defining an outer perimeter, and a bottom surface. In a preferred embodiment, a plurality of apertures may be formed in the bottom surface. A plurality of anchors are adapted to be attached to the tombstone in these apertures and anchored in the ground. The anchors include an enlarged member and a connector projecting from the enlarged member. The enlarged member is anchored in the ground and the body is secured to the rod to prevent removal of the body. The outer inscription surface is readily visible when the body is anchored in the ground.

In another form of the invention, a tombstone/monument includes a one-piece solid body formed from a moldable polymeric material, the body having a base portion and an upright display portion extending upwardly from the base portion. The display portion has an inscription area receiving at least one of engraved indicia formed in the surface of the inscription area and separately formed, raised indicia secured to the inscription area. The separately formed, raised indicia each include at least one securing member mounted in the inscription area. The base has a bottom surface adapted to engage one of the ground and a support member set on the ground. Further, the body has a sufficient weight to maintain a desired, stable position on the ground or support member, while including areas having a textured surface providing the appearance of natural cut stone.

According to another embodiment of the invention, a method is provided to secure a tombstone/monument to the ground. The method includes the step of providing a molded tombstone/monument. Anchors are attached to the molded tombstone and holes are formed in the ground. The tombstone anchors are placed in the ground, and the holes are filled to bury the anchors in the ground and firmly hold the molded tombstone in position adjacent the holes. According to narrower aspects of the invention, the anchors may be positioned in a hole in the ground and secured by filling in the hole. The tombstone may also be secured to a concrete block.

In other aspects, the moldable polymeric material preferably is a polyester resin including a granite affect filler material providing the appearance of natural granite. Such filler material may include a highlight particulate matter including at least one of alumina trihydrate and calcium carbonate. Alternately, the polymeric material may be coated with gel coat for protection or may include reinforcing additives for increased strength, such as glass fibers, glass microbubbles or polyurethane foam.

Preferably, the inscription area is smooth for receipt of either the engraved or separately formed, attached indicia. Also, the base preferably has an outer perimeter defining an area larger than the upright display portion.

The present invention is sufficiently heavy to provide a secure, stable positioning yet light enough to be shipped on normal commercial carriers such as UPS. The present tombstone or monument is significantly less costly to manufacture than traditional stone monuments yet provides a textured surface and is made from a moldable, polymeric material which provides the appearance of natural, cut granite or stone. In addition, the tombstone or monument is solid and durable, thereby eliminating moisture, impact and stress problems when exposed to severe weather conditions over a longer period of time. It is also adaptable for inclusion of either engraved or raised letter personalized inscriptions depending on the customer desires and can be delivered in a short time period. Further, the monument can include additional anchors for insertion into the ground to maintain the monument in position, which anchors can be used in conjunction with a concrete slab for additional stability, if desired. The monument may be carried by an individual to that actual burial site. It is easy to install and securely anchored once installed, and is weather resistant and ultraviolet (UV) stable.

These and other aspects, features and advantages of the invention will become more apparent after contemplation of the ensuing more detailed description, particularly when considered with and in light of the accompanying drawings in which:

BRIEF DESCRIPTION OF THE DRAWINGS

FIG. 7 is a cross-sectional view similar to that in FIG. 5 of another alternate embodiment of the the without any anchors therein;

FIG. 8 is a side elevational view of the tombstone assembly according to FIG. 1 with the anchor assembly lowered into holes;

FIG. 11 is a side elevational view similar to that in FIG. 5 and showing an alternate embodiment of the invention wherein the tombstone is shown partially broken away and a portion of the tombstone is shown in cross section, the tombstone anchored to a concrete slab;

FIG. 12 is a side elevational view similar to that in FIG. 5 and showing a tombstone mounted to a precast cement slab wherein the tombstone is shown partially broken away and a portion of the tombstone is shown in cross section;

FIG. 13 is a side elevational view of another mounting arrangement of a tombstone which uses a crete slab with a portion of the tombstone body taken in section;

DETAILED DESCRIPTION OF THE PREFERRED EMBODIMENTS

Figure 1:
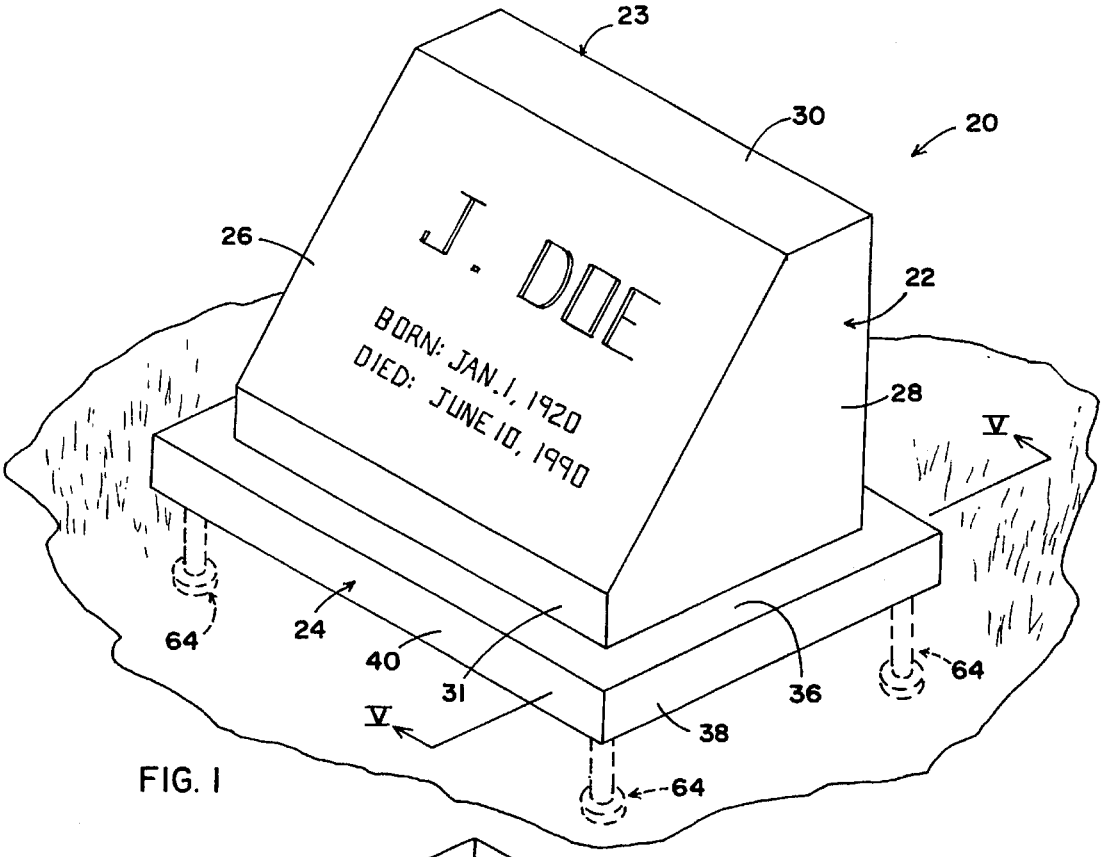
FIG. 1 is a top perspective view of a molded tombstone according to the invention.
Figure 2:
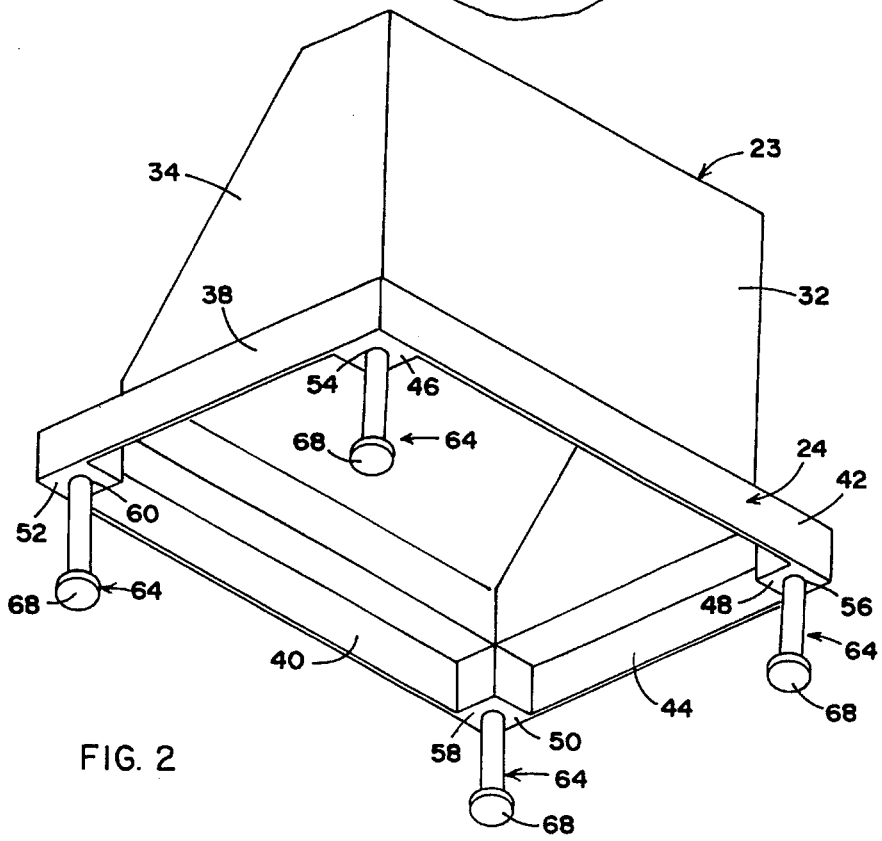
FIG. 2 is a bottom perspective view of the tombstone according to FIG. 1.

A tombstone 20 according to the invention is illustrated in FIGS. 1 and 2. The tombstone body or shell 23 is hollow having molded walls which are preferably molded of a composite polymer. Shell 23 may have any shape but, in the illustrated embodiment, has an upright, top section 22 which is trapezoidal in sectional shape, and a lower base section 24, which is larger in area than top section 22. Sections 22 and 24 are integrally molded, or molded separately and fused integrally together at the factory prior to shipment. Top section 22 includes an inscription surface 26 which is angled between a horizontal top 30 and a vertical front 31. A sidewall 28 extends orthogonally to front wall 31 and top wall 30. A sidewall 34 (FIG. 2) extends parallel to wall 28 on an end of the tombstone opposite wall 28. Back wall 32 extends orthogonally to top wall 30 and sidewalls 28 and 34.

With continued reference to FIGS. 1 and 2, base section 24 includes a horizontal perimeter top 36 which circumscribes the lower perimeter of top section 22. An end wall 38 extends downwardly from wall 36. A front wall 40 also extends orthogonally from intermediate top 36 and end wall 38. A back wall 42 extends downwardly from top 36 and parallel to back wall 32. An end wall 44, on an opposite end of tombstone 20 from end wall 38, also extends downwardly from intermediate wall 36 and parallel to end wall 38.

Base section 24 also includes four corner blocks 46, 48, 50 and 52, best illustrated in FIG. 2, which extend inwardly at the joinder of walls 38, 40, 42 and 44. Each of the corner blocks 46, 48, 50 and 52 includes a respective aperture 54, 56, 58 and 60 for receipt of a respective anchor 64, which is buried in the ground below tombstone 22, as described in greater detail hereinbelow. Anchor 64 secures the tombstone to the ground in a novel manner which is both easy to implement and effective in securing the tombstone.

Somewhat more particularly, sections 22 and 24 (FIGS. 1 and 2) of tombstone shell 23 are manufactured using conventional compression or injection molding techniques. Suitable materials include a polyester bulk molding compound, which may, for example, include 30 to 40 percent grade 46-16 polyester resin, 15 to 30 percent glass fiber, 30 to 55 percent calcium carbonate, and less than 2 percent coloring pigment. The shell walls have a thickness of between ⅛ and ½ inch, and most preferably have a thickness between ¼ and ⅜ inch. The shell is substantially rigid and hard throughout the wall thickness, and is UV stabilized and weather resistant such that it is durable and strong. The shell has the appearance of granite, but is light in weight. This makes shipping and installation significantly easier and less expensive than for stone monuments. Although the shell is preferably molded from bulk molding compound, as described above, it can also be molded from composite polyester or phenolic-based material. Alternatively, a reaction injection molding (RIM) process may be used.

According to an alternate embodiment of the invention, the hollow interior of the molded tombstone defined by shell 23 may be filled with a structural foam 62 (shown in FIG. 7). The structural foam preferably comprises the same material as the shell, and has a blowing agent such as nitrogen, or light hydrocarbon, therein. The foam thus includes cells dispersed throughout the molding compound which is blown into the interior of the shell 23 (FIG. 2) to fill the entire shell. When the foam hardens, it forms a solid core which adds strength to the shell and eliminates the hollow volume of the shell. The density of the foam is dependent upon the size of the nitrogen cells in the foam, and preferably, large cells are formed to provide a porous core. The cells preferably have a diameter of 10/1000 to 30/1000 of an inch. The weight that the structural foam adds to the tombstone will be between five and fifteen pounds, such that the total weight, for the monument reduced to practice as described hereinbelow, is approximately thirty-two to forty-two pounds.

After the tombstone is molded, an inscription is engraved into surface 26 (FIG. 1). The preferred method of engraving uses a computer implemented numerical engraving technique. This technique utilizes AUTO CAD™, or other commercially available graphics software, loaded on a commercially available PC (not shown) to generate an inscription. The inscription is communicated to a Controlled milling machine (not shown) by SMART CAM™ or other commercially available software for interfacing between a graphics software program and the milling machine. Suitable controlled milling machines are commercially available from Cincinnati Milicron or other milling machine manufacturers. The milling machine automatically cuts the inscription into the surface 26 of shell 23. The generation of the inscription is thus made quickly and may be controlled accurately before engraving occurs. Additionally, the inscription is made directly into the molded shell.

With reference now to FIG. 2, the tombstone is preferably anchored at the corners. Accordingly, the corners are reinforced by rectangular corner blocks 46, 48, 50 and 52, as described above. The corner blocks may be integrally molded with the lower section 24. Alternatively, the corner blocks may be formed separately and fused with lower section 24 at the factory by conventional fusing or securing techniques. For example, the corner blocks could be attached by ultrasonic welding, use of an adhesive, or use of a fastener (not shown). Although the comer blocks are preferably rectangular, they may be rounded.

Figure 5:
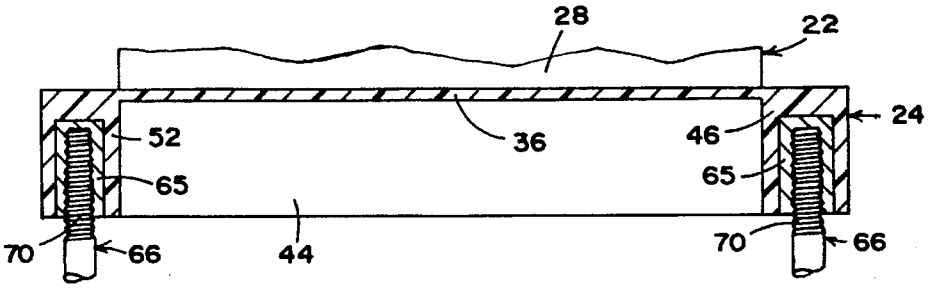
FIG. 5 is a cross-sectional view of the monument body and fragmentary portion of the anchor taken along plan V—V of FIG. 1.
Figure 6:
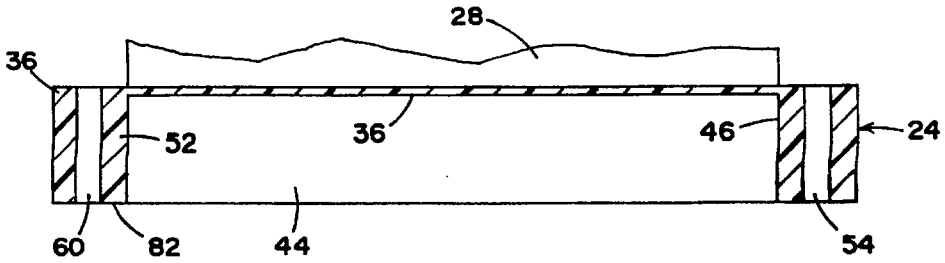
FIG. 6 is a cross-sectional view similar to that in FIG. 5 of an alternate embodiment of the tombstone body without any anchors secured therein.

Apertures 54, 56, 58 and 60 (FIG. 2) are formed in the comer blocks and may be provided in one of three forms. These apertures may open downwardly, and be threaded, as illustrated in FIG. 5, for directly receiving the threaded ends 70 of anchor 64. These threads may be formed by conventional machining techniques such as boring. However, in the preferred embodiment, a metal, internally threaded cylinder 65 is inserted into each of the corner blocks 46, 48, 50 and 52 (FIG. 2). The cylinder 65 (FIG. 5) is preferably integrally molded into the corner blocks 46, 48, 50 and 52 by supporting the threaded cylinders on pins in the mold when the shell is formed. The molding compound will adhere to the cylinders when the molding compound hardens in the mold. Alternatively, the cylinders may be attached to the corner blocks by press-fitting, applying an adhesive, or the like. Threaded fastener 65 receives the threaded end 70 (FIG. 3) of anchor 64. Alternatively, and as illustrated in FIG. 6, apertures 54, 56, 58 and 60 may be bored through the corner block and extend from the bottom 82 to the top surface of intermediate perimeter top 36. According to a third embodiment illustrated in FIG. 7, a counterbore 82 is bored from top 36 in each aperture. Counterbore 82 has a common central axis with the apertures. The counterbore receives a nut 72 (FIG. 9) fastened on post 66 and a cap 90 (FIG. 10) to seal out water, dirt, and the like, and reduce corrosion of anchor end 70 and nut 72. The caps also cover the nuts such that they are hidden from view.

Figure 3:
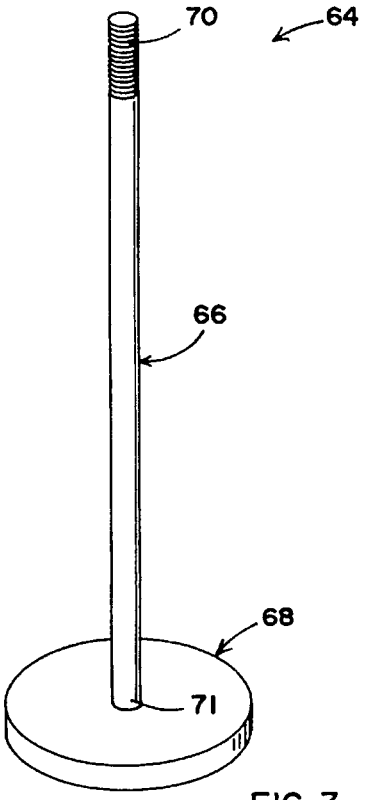
FIG. 3 is a top perspective view of an anchor assembly for the molded tombstone according to FIG. 1.
Figure 4:
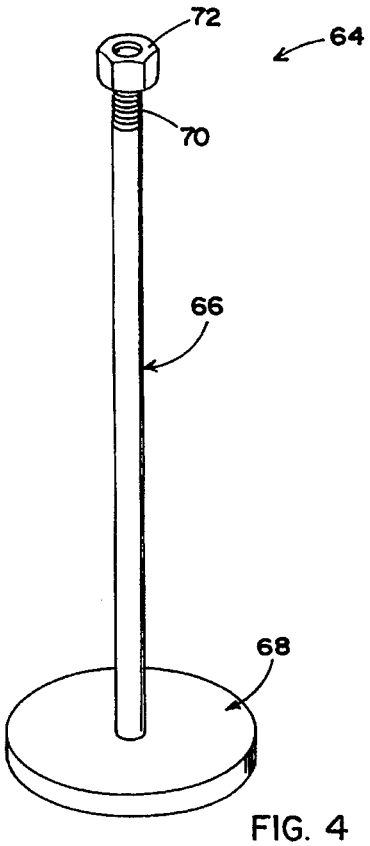
FIG. 4 is a top perspective view of the anchor according to FIG. 1 further including a hex nut.

The tombstone is secured using anchor assemblies 64, which are best illustrated in FIG. 3. Each anchor assembly 64 includes a connector, post, or rod 66 projecting orthogonally from an enlarged base 68. Post 66 and base 68 are preferably manufactured of a suitable non-corrosive metal such as galvanized steel or bronze. Anchor base 68 is preferably round, having a central aperture for receipt of shaft 66, and is larger than post 66 for retention in the ground. Distal end 70 includes threads received in apertures 54, 56, 58 and 60, as described in greater detail hereinbelow. Post 66 may be integrally formed with base 68 or attached thereto using any suitable conventional technique. For example, end 71 of post 66 may be threaded for receipt in the threaded aperture centrally located in base 68. A locking device, such as a nut (not shown) may be utilized to secure post 66 against rotation out of base 68. Although base 68 is preferably round for ease of forming a hole to receive the base, the base may have other shapes. For example, the base may be square or octagonal, without significantly affecting the functionality of anchor 64.

In one reduction to practice, tombstone shell 20 has a length of thirty inches, a depth of fourteen inches and a height of twenty inches. The anchor base has a diameter of four inches and post 66 has a height of twelve inches, having a three-eighth inch diameter.

The mounting and installation of the tombstones will now be described. According to the first anchoring method illustrated in FIG. 8, four holes 99 (two of which are shown) are dug approximately four inches in diameter and ten inches deep. The holes are spaced such that the center of each hole 99 is aligned with one of apertures 54, 56, 58 and 60. The hole pattern is thus dug to match the tombstone. The threaded ends 70 (FIG. 5) of posts 66 are screwed into the threaded apertures in the tombstone. The anchor assemblies 64 will thus extend downwardly, as illustrated in FIGS. 5 and 8. Tombstone shell 23 and anchor assemblies 64 are positioned over holes 99 and each anchor is lowered into a respective one of the holes 99 to the fully inserted position, illustrated in FIG. 8. The holes are then filled with dirt to secure the tombstone in the ground.

Figure 9:
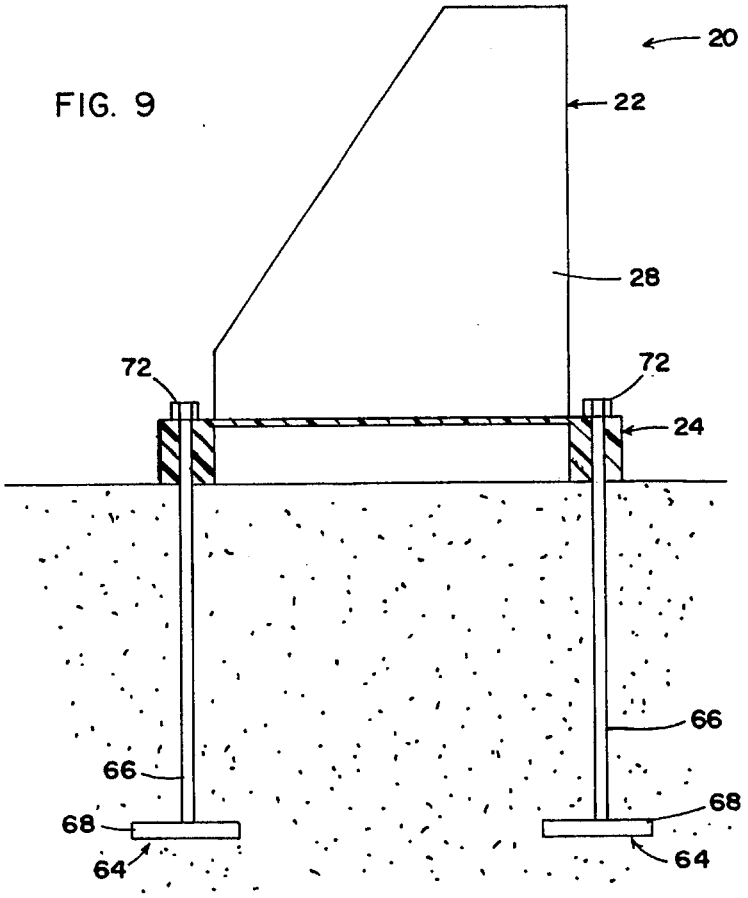
FIG. 9 is a side elevational view of a tombstone assembly according to an alternate embodiment of the invention but showing a portion of the tombstone in section.

According to another mounting method illustrated in FIG. 9, bolts 72 are utilized for securing each anchor to the tombstone. This mounting method uses the apertures according to FIG. 6. The anchors may be placed into the holes such that two inches of each post, including the threaded end 70, projects upwardly above the ground. Holes are then filled with dirt to prevent release of the anchor. Apertures 54, 56, 58 and 60 (FIG. 1) are then aligned with a respective anchor. The tombstone is then lowered onto anchor posts 66 which are received into each of the apertures. Bolts 72 are tightened onto anchor posts 66.

Figure 10:
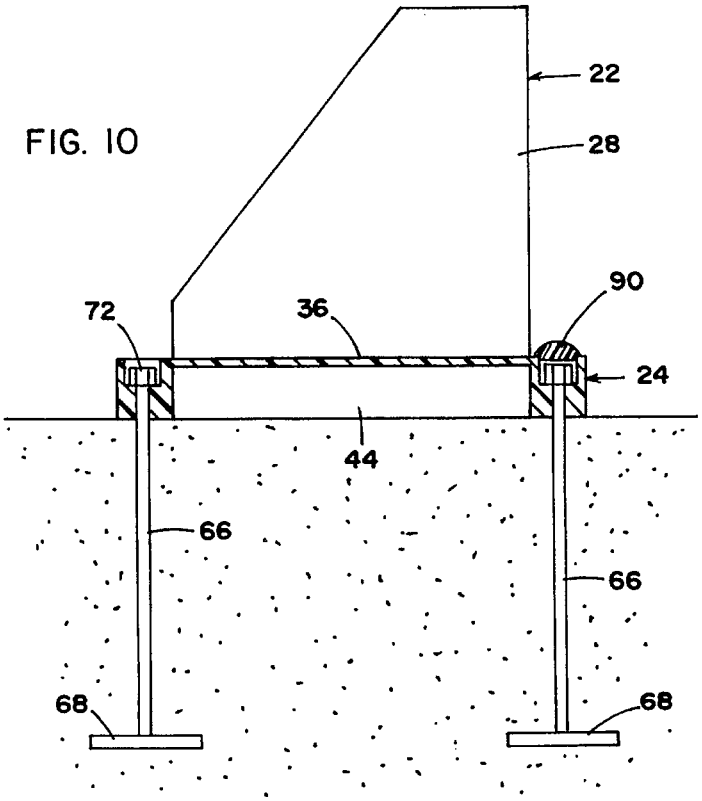
FIG. 10 is a side elevational view of a tombstone assembly according to yet another embodiment ofyinvention showing a portion of the tombstone in section.

The counter bored apertures 82 illustrated in FIG. 7 may also be used. As illustrated in FIG. 10, nut 72 is screwed onto post 66 in counterbore 82 after the anchors are buried in the ground and the tombstone is lowered onto the anchors. Cap 90 is plugged into counterbores 82. Cap 90 is preferably manufactured of the same material as the tombstone itself, such that the cap is not readily noticeable. Alternatively, cap 90 may be provided by a suitable metal manufactured in a conventional manner. It is envisioned that anchor assemblies 64 may be mounted to the tombstone using nuts 72 before the anchors are inserted into the ground. The holes 99 are then backfilled after the tombstone rests on the ground. Caps 90 are pressed over each counterbore 82 after anchor assemblies 64 are buried.

Although the tombstone may be effectively anchored into the ground using anchors 64 buried in soil, as described above, it is also envisioned that the tombstone can be anchored in concrete using anchors 88 (FIGS. 11–14). Each anchor 88 is provided by a bolt which may, for example, be a six inch long a three-eighths diameter hex bolt. Head 90 of each bolt is positioned in the concrete to prevent removal of the bolt. Bolt 88 may be attached to the threaded cylinder 65 (FIG. 11) or nut 72 may be assembled onto the threaded end of each bolt 88 (FIG. 13).

Somewhat more particularly, to mount the tombstone to a wet concrete slab, a respective bolt 88 is attached to cylinder 65 in each of the corner blocks 46, 48, 50 and 52 (FIG. 2). Cement is poured into a hole formed in the ground, and the bolts are inserted into the wet cement. When the cement sets, the shell will be secured to the ground.

According to another embodiment of the invention, the concrete block 100 is precast with four holes therethrough. The holes in the monument are aligned with the apertures 54, 56, 58 and 60 through the block. Bolts 88 are inserted through the holes in the block and screwed into cylinders 65. The shell 23 is thus secured to the block, and the block is positioned in a hole in the ground.

An alternate method of mounting tombstone shell 23 is illustrated in FIG. 13, wherein bolts 88 are anchored to concrete slab 92 before the concrete sets. Four bolts 88 are pressed into the concrete at locations aligned with one of apertures 54, 56, 58 and 60, respectively. The bolts are positioned in the concrete such that a hex nut 72 may be attached above lower section 24 of the tombstone when the tombstone is placed onto the concrete slab. Hex nut 72 may then be locked onto the bolts 88 to securely anchor the tombstone on the concrete slab. Although not illustrated, it is envisioned that the tombstone, including counterbore 82, may be used with anchors 88 and block 92. Nut 72 is tightened into counterbore 82 of FIG. 7. A cap is then pressed over the top of the counterbore to close the counterbore, including the hex nut 72 secured therein. It is also envisioned that bolts 88 can be attached to the tombstone before the bolts are pressed into the concrete. The bolts may be attached to the shell 23 using a hex nut 72 secured into counterbore 82. Bolt 88, extending downwardly from shell 21, can then be pressed into the concrete before it sets.

Figure 14:
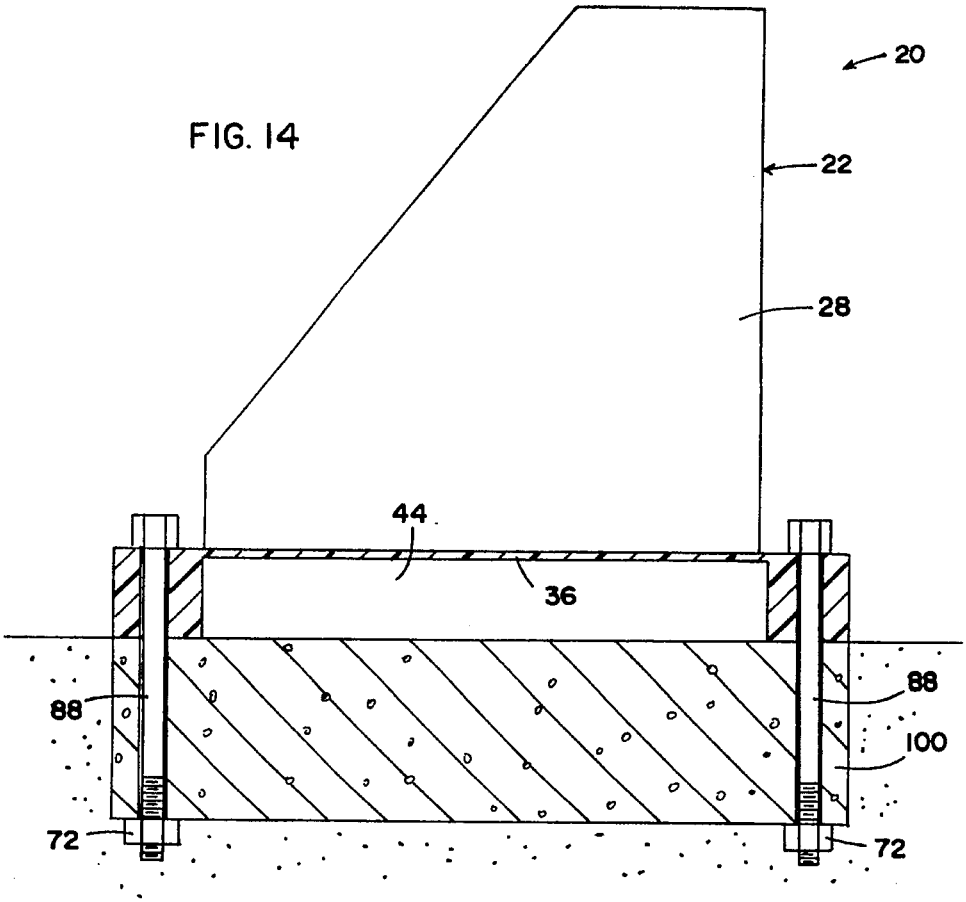
FIG. 14 is a side elevational view of yet another alternate mounting arrangement of a tombstone on a concrete slab with a portion of the tombstone body taken in section.

As illustrated in FIG. 14, tombstone shell 23 may also be assembled to a precast concrete slab 100. To attach the tombstone to a precast cement slab, four holes are precast in concrete slab 100 or formed by other conventional means, such as using a drill. In either case, the holes are spaced for alignment with the four apertures 54, 56, 58 and 60 at the four corners of tombstone 20. A hex bolt 66 is inserted through apertures 54, 56, 58 and 60 and into the openings formed in the precast concrete. The head of bolt 66 is adjacent perimeter top 36. Hex nut 72 is then attached to the bottom of the concrete slab, as illustrated in FIG. 14. The tombstone and concrete are then placed into a hole formed in the ground and backfilled around the perimeter.

Figure 15:
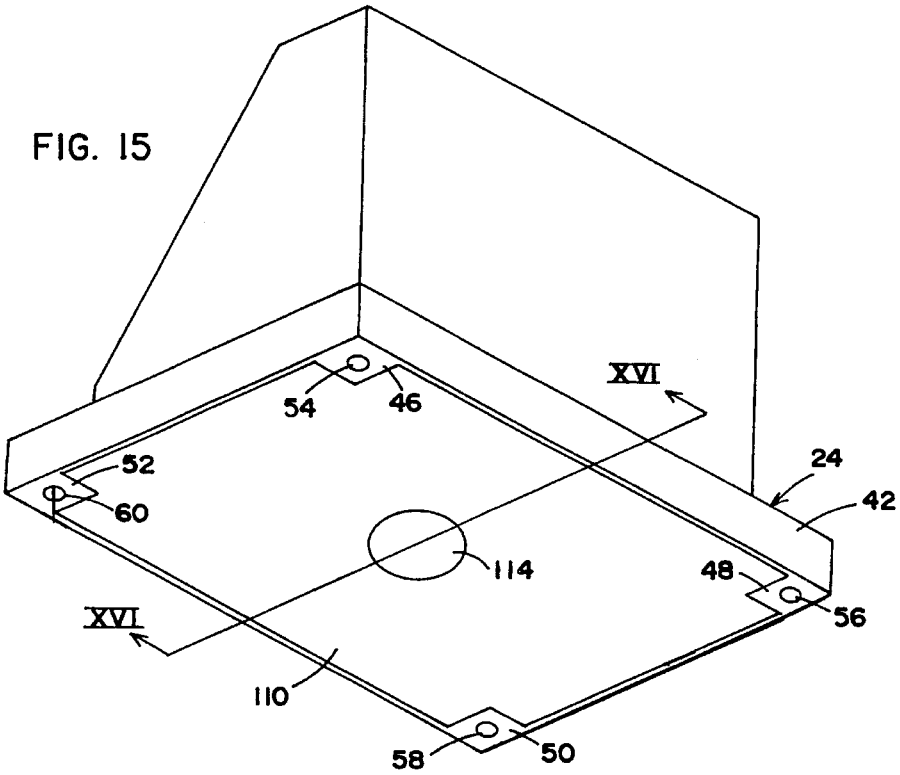
FIG. 15 is a bottom perspective view of a molded tombstone according to an alternate embodiment of the invention.
Figure 16:
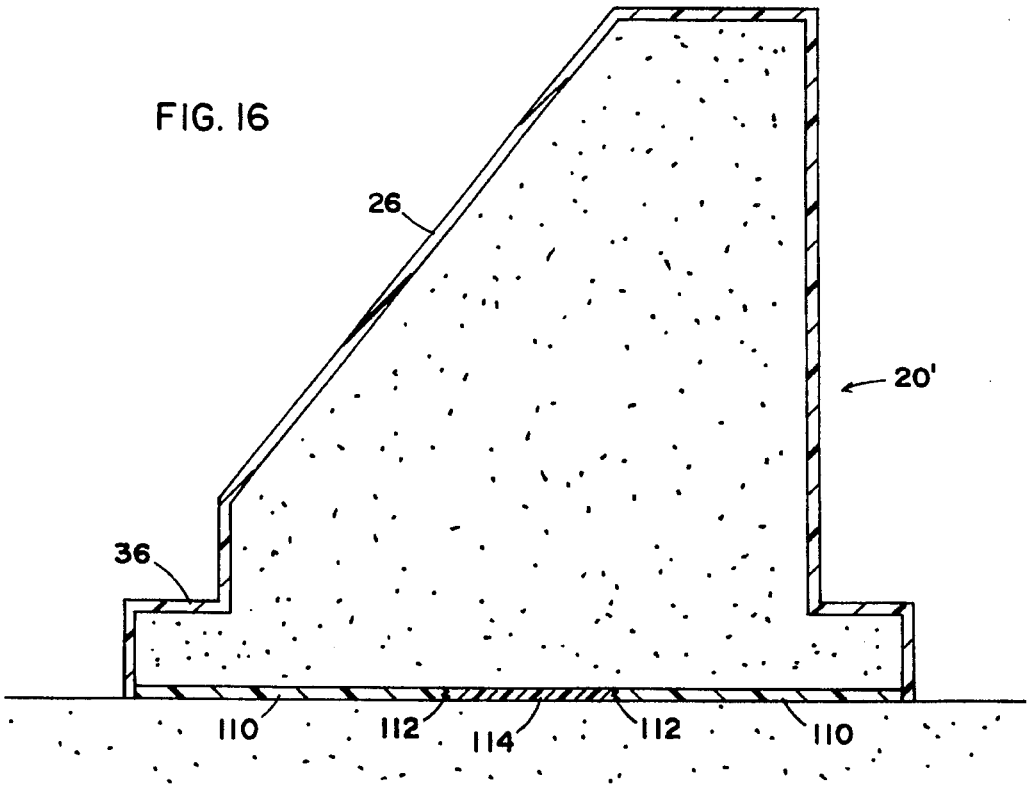
FIG. 16 is a side sectional view taken along plane XIV—XIV in FIG. 15 showing a sand filled tombstone according to the alternate embodiment of FIG. 13.

According to yet another embodiment of the invention illustrated in FIGS. 15 and 16, the interior of shell 21 is filled with sand. To provide a shell which will hold sand, a sheet 110 is fused to the bottom of shell 23 at the factory. The fusion may be provided using an adhesive, ultrasonic welding, or the like. Sheet 110 has a central opening 112 which may, for example, be a threaded opening. A plug 114 is adapted to be fitted into opening 112. The plug may utilize snap connectors (not shown), metallic fasteners (not shown), or have a threaded outer perimeter. At the cemetery, the tombstone is filled through opening 112. Opening 112 is plugged using plug 114. The tombstone is then placed on the ground or on a concrete slab. The sand provides additional reinforcement for the tombstone, as well as adding significantly to the weight of the tombstone. If desired, the sand filled tombstone may also be anchored using anchor assemblies 64 or bolts 88 using any of the various methods described herein.

Figure 17:
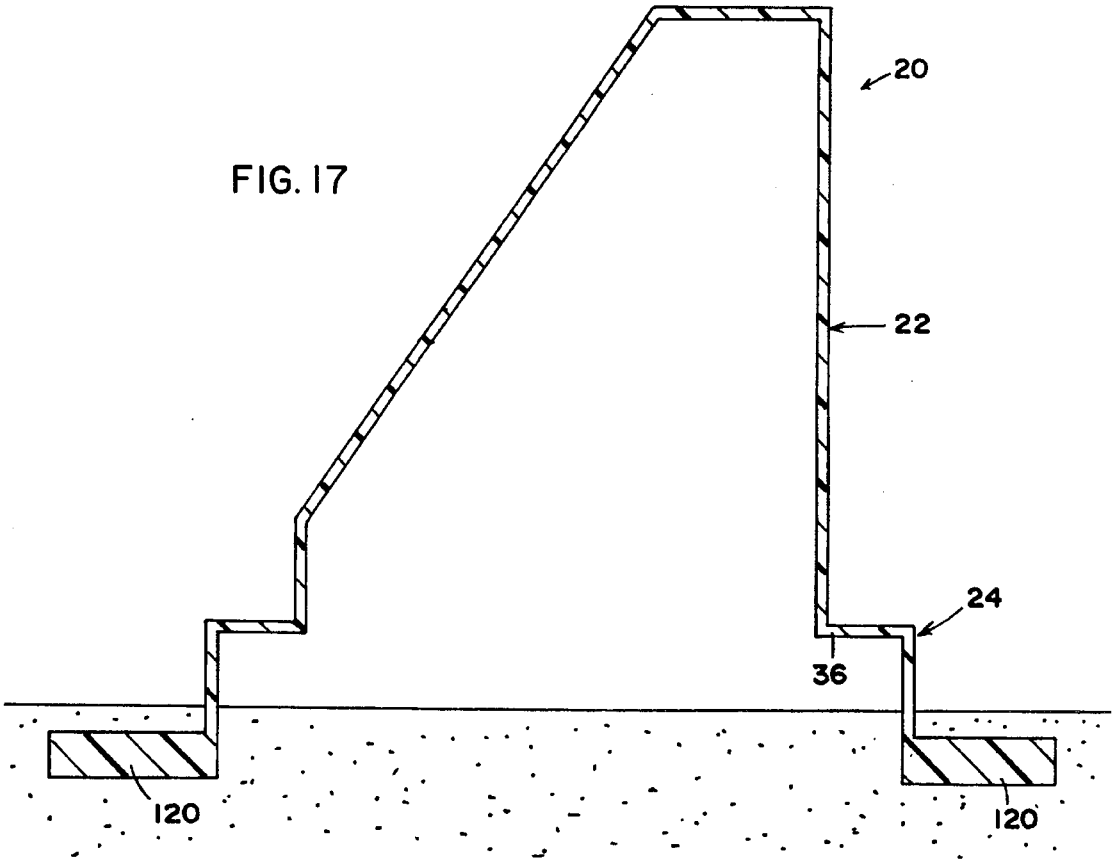
FIG. 17 is a side sectional view similar to that of FIG. 16 of yet another alternate embodiment of the invention.

According to another mounting method shown in FIG. 17, a shell 23 includes an outwardly projecting flange 120 formed around the perimeter of base 24. Flange 120 is integrally molded with lower section 24 of the tombstone, or fused to the lower section at the factory. To mount the tombstone including flange 120, a hole is dug which is large enough to receive flange 120. The tombstone projects upwardly from this flange. Fill is placed over the top of the flange, such that the tombstone will have the appearance of extending down into the ground. After the flange is covered with dirt, it is difficult to lift the tombstone, and the flange provides a secure anchor for the tombstone. It is envisioned that shell 23 including flange 120 may also be anchored using anchor assembly 64, and any of the various methods described herein.

Figure 18:
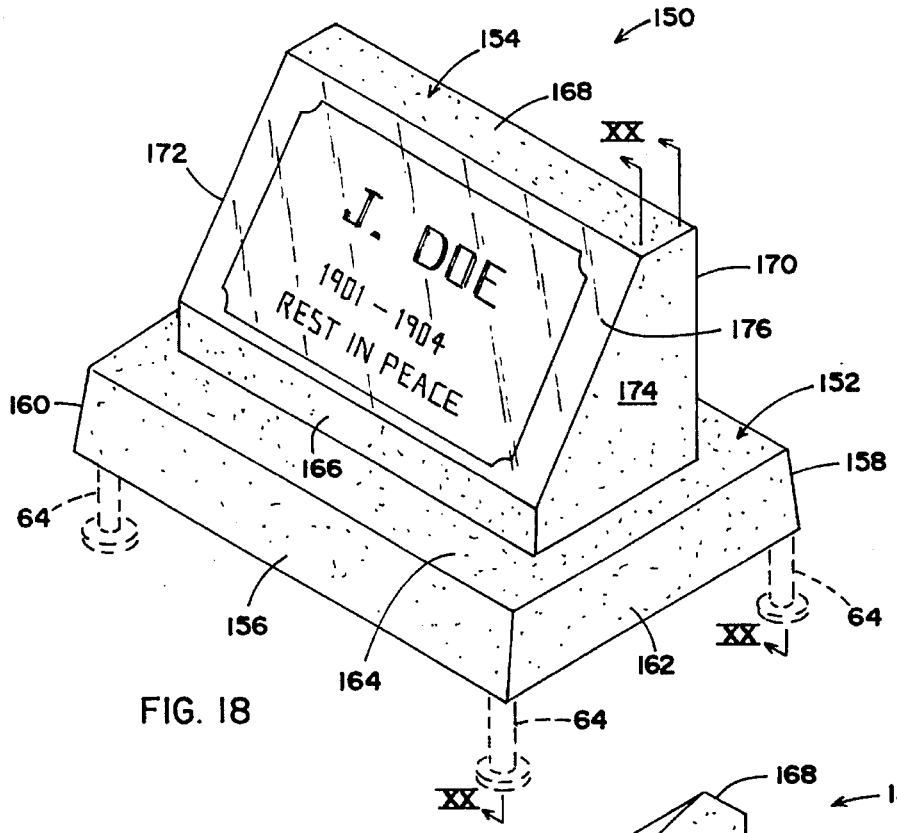
FIG. 18 is a top perspective view of another embodiment of the molded tombstone/monument according to the present invention.
Figure 19:
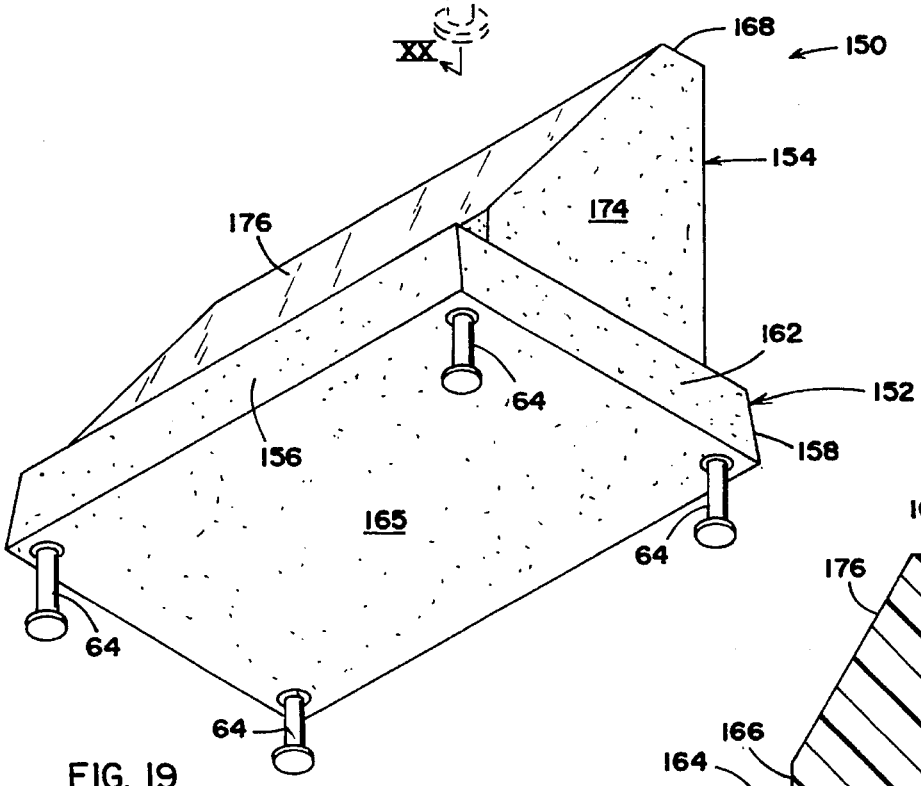
FIG. 19 is a bottom perspective view of the tombstone/monument shown in FIG. 18.
Figure 20:
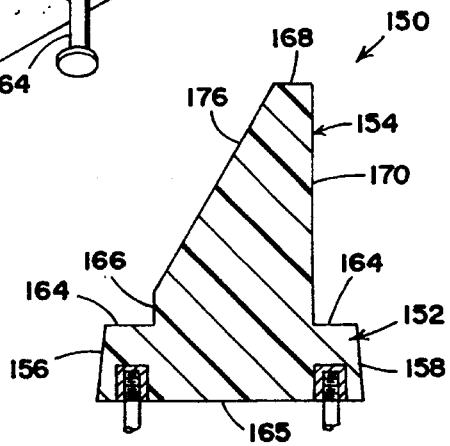
FIG. 20 is a sectional side elevation taken along plane XX—XX of FIG. 18.

Referring now to FIGS. 18–25, another embodiment 150 of the tombstone/monument invention is illustrated. As is best seen in FIGS. 18–20, embodiment 150 is of solid, one-piece construction and includes a generally rectangular base 152 and an upright display portion 154 extending upwardly from the base. Base 152 includes slightly outwardly tapered side and end surfaces 156, 158 and 160, 162, respectively, defining an outer perimeter which is larger than the upwardly extending display portion 154. Base 152 also includes a generally horizontal upper surface 164 adjacent the display portion and a bottom surface 165. Display portion 154 is generally trapezoidal in section and includes a lower from side surface 166 perpendicular to upper surface 164, a horizontal, top surface 168, rear surface 170 and parallel, vertical end surfaces 172, 174. Extending between the front surface 166 and top surface 168 of display portion 154 is an inclined or slanted inscription area 176 adapted to receive engraved indicia, such as letters, numbers or other symbols identifying the tombstone or monument, or alternately, raised indicia forming letters, numbers or other symbols separately formed and attached to the inscription area 176 as is more fully explained below.

Preferably, tombstone/monument embodiment 150 is formed from a composite polymeric material by injection molding or other conventional molding techniques. A preferred material is polyester resin which preferably also includes a granite affect filler material providing the appearance of natural granite. The granite affect filler material is a highlight particulate matter preferably selected from either alumina trihydrate ($A1\ 2O_3$) or calcium carbonate ($Ca\ CO_3$). Alternately, the polyester resin molded monument may be coated with gel coat for protection against the elements in outdoor environments, and may also include reinforcing additives to increase the strength of the molded material. Suitable reinforcing additives include glass fibers, glass microbubbles, and polyurethane foam having a density within the range of between about 1 and 5 pounds per cubic foot.

In the preferred embodiment, all surfaces of tombstone/monument 150, except for inscription area 176 and bottom surface 165 are preferably molded with a textured, slightly roughened surface which simulates the appearance of natural cut granite or stone. Surfaces 176 and 165 are preferably smooth, flat or planar. Surface 176 may be polished if desired. When combined with the polyester resin including the granite affect fillers, tombstone/monument 150 closely simulates the appearance of natural cut granite and reduce the appearance of scratches or marring. When formed in this fashion, tombstones or monuments have sufficient weight for stable positioning on the ground without requiring anchoring. For example, a tombstone having the base dimensions of 14 inches by 30 inches by 4 inches, and display portion dimensions of 10½ inches by 24 inches by 14¼ inches with top surface 168 1-⅞ inches wide and front surface 166 2 inches high, and generally in the configuration shown in FIGS. 18–20, has a weight of approximately 76 pounds when formed from polyester resin with the granite affect fillers described above. Notably, although sufficiently heavy for stable support on the ground, such molded monuments can easily be shipped by commercial carriers such as United Parcel Service from a factory to a burial site without requiring special shipping.

As explained above in connection with the previous embodiments of the invention, tombstone/monument 150 may include inscriptions engraved into inscription area 176 using the methods described above including computer implemented, numerical engraving techniques with AUTO CAD™ or other commercially available graphic software. As shown in FIG. 18, names, dates and other identifying information, as well as designs, may be inscribed using such methods by computer controlled milling machines which formed the indicia directly in the smooth surface of inscription area 176.

Figure 23:
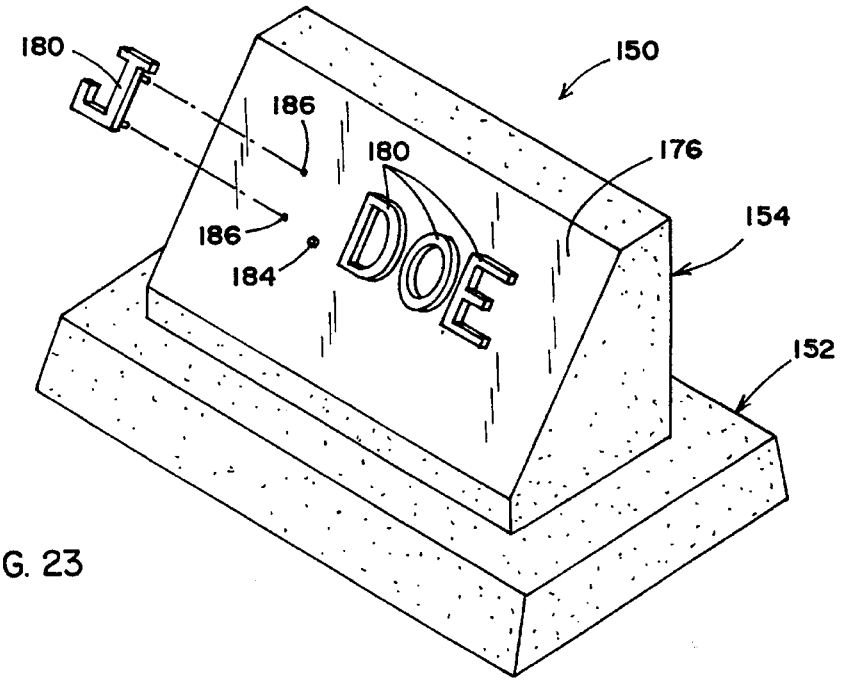
FIG. 23 is a top perspective view of a further embodiment of the tombstone/monument shown in FIG. 18 but including separately formed, raised letters secured on the inscription area of the monument.
Figure 24:
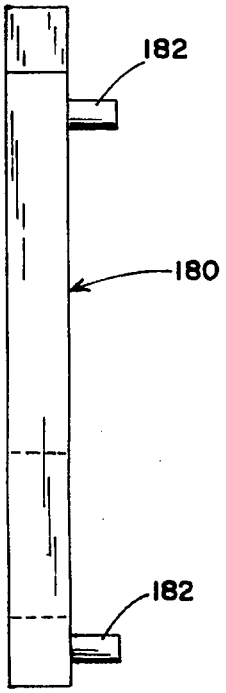
FIG. 24 is a side elevation of one of the raised letters shown in FIG. 23.
Figure 25:
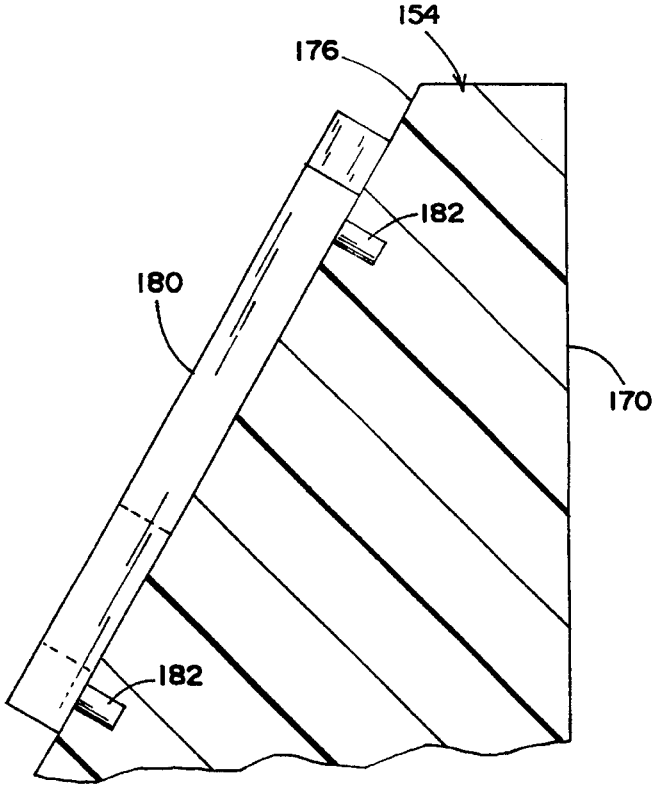
FIG. 25 is a sectional side elevation of the monument of FIG. 23 showing one of the raised letters secured in place on the inscription area thereof.

Alternately, as shown in FIGS. 23–25, separately formed indicia, such as letters, numbers or other symbols, may be made and attached to the inscription area 176. As illustrated, letters or other indicia 180 may be separately formed by molding or other processes and include locating bosses or pegs 182 formed on the underside thereof. Pegs or bosses 182 are typically formed on the preferably planar undersurface of each separately formed letter or indicia and extend perpendicularly outwardly from such planar undersurface. Punctuation marks, such as that shown at 184 which comprise a single peg or the like, may also be included. Each letter or punctuation mark is preferably positioned on inscription area 176 by suitable design software on a computer showing the inscription area, enabling the location of mounting holes for the indicia. After the proper location for the indicia have been established on the computer, the programming is directed from the computer to a computer controlled drill press or other machine which prepares the hole pattern by drilling the blind bores comprising the mounting holes in the appropriate locations on inscription area 176. Thereafter, indicia, such as letters 180, may be located with mounting bosses or pegs 182 fitted within mounting holes 186 such that the mounting arrangement is concealed after installation. Each letter or other indicia is preferably molded from the same moldable polymeric material from which tombstone/monument 150 is formed, namely, polyester resin including granite affect filler in the preferred embodiment. For secure attachment of the indicia 180 to the inscription surface 176, a suitable adhesive may be applied to the undersurface of the letter or to mounting bosses 182 or mounting holes 186 immediately prior to attachment of the indicia. Such adhesive forms a chemical bond which permanently attaches the lettering to the inscription surface. A suitable adhesive for use with the preferred polymeric material, namely, polyester resin is No. 4693, available from AIN Plastics Company of Southfield, Mich., a distributor of 3M adhesives.

Figure 21:
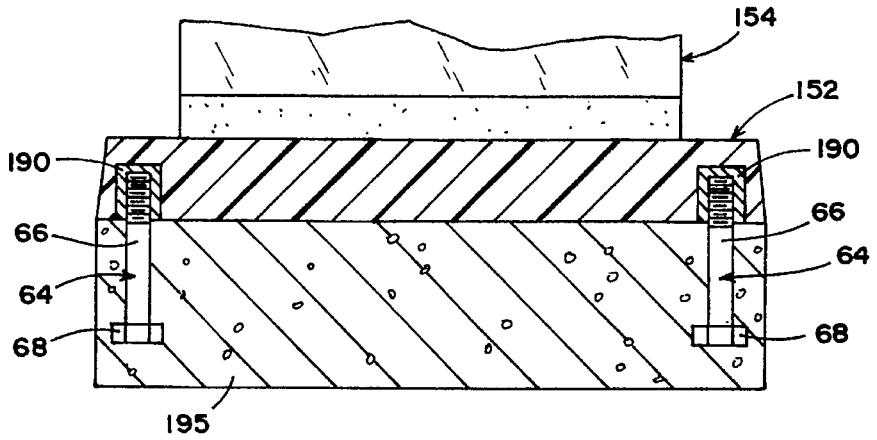
FIG. 21 is a fragmentary, front view, shown partially in section, of the tombstone/monument embodiment of FIG. 18 supported on a concrete slab in the manner shown in FIG. 11.
Figure 22:
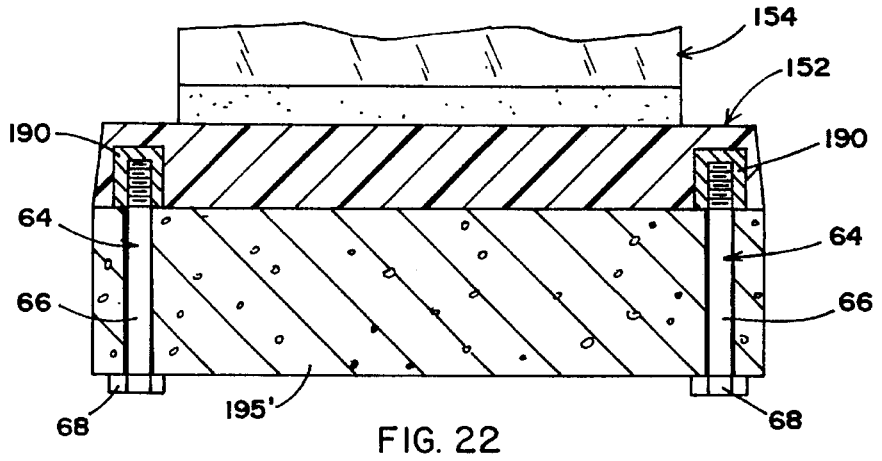
FIG. 22 is a fragmentary, front view, shown partially in section, of the tombstone/monument of FIG. 18 shown supported on a concrete slab in the manner shown in FIG. 12.

As is shown in FIGS. 20–22, optional anchors may be used as in the other embodiments of the invention described above. As illustrated, cylindrical metal inserts 190 may be secured in corresponding apertures formed in the planar bottom surface 165 of base 152 near or adjacent the four corners of the base. The ends of the cylindrical inserts 190 are preferably flush with the bottom surface after installation and open through the bottom surface. The inserts are concealed from view from the exterior. Each metal insert is internally threaded and adapted to receive an anchor member 64, such as that described above. Each anchor includes a connector, post or rod 66 projecting perpendicularly from an enlarged base 68 and having a threaded end on rod 66 opposite to the end including the enlarged base 68. As described above and as shown in FIG. 8, the anchor rods 66 may be formed with sufficient length to allow burying of the anchors in the ground by positioning the anchors in previously dug holes and filling in dirt over the enlarged bases 68 after the tombstone/monument 150 is positioned in registry with the holes on the ground surface.

Alternately, tombstone/monument 150 can be anchored using concrete slabs as described above in connection with FIGS. 11 and 12. As shown in FIG. 21, shorter anchors 64 may be threaded into inserts 190 with the tombstone positioned over the area of wet concrete forming a slab 195. The anchors are inserted into the wet concrete until the bottom surface 165 engages the top surface of the concrete. When the cement sets, monument 150 is permanently secured to the ground on the concrete slab 195.

Alternately, a concrete slab 195 may be precast with four holes therethrough adapted to receive anchor rods 66. The holes in the monument formed by inserts 190 are aligned with the apertures through the slab 195'. The anchor rods are inserted through the holes in the slab and screwed into cylinders 190 thereby securing the monument to the slab 195' with the slab positioned in a hole in the ground.

Accordingly, it can be seen that a tombstone/monument is disclosed which is both stable and durable. The tombstone is relatively inexpensive to manufacture. The tombstone may be easily shipped by courier and/or carried by an individual. The tombstone may be personalized with engraved or raised inscriptions and delivered in a short period of time. Additionally, the tombstone may be anchored using a secure, versatile anchoring system.

It is to be understood that the foregoing description of the preferred embodiments of the invention is provided for purposes of illustration, and not as a measure of the invention, whose scope is to be defined by reference to the ensuing claims. All such alternative or modified embodiments which utilize the underlying concepts of the invention and incorporate the spirit thereof are to be considered as within the scope of the claims depended hereinbelow, unless such claims by their language specifically state otherwise.

The embodiments of the invention in which an exclusive property or privilege is claimed are defined as follows:

1. A tombstone/monument assembly comprising:

a one-piece molded, solid body formed from a moldable polymeric material and having an outer inscription area on an exterior surface, a base defining an outer perimeter, and a bottom surface, said body also including a plurality of apertures in said bottom surface, said apertures being concealed from view from said exterior surface; and a plurality of anchors for attachment to said body at said apertures and thereafter to be anchored to the ground, each of said anchors including an enlarged member and a connector projecting from said enlarged member, whereby said enlarged member is anchored in the ground and said body is secured to said connector to prevent removal of the body when the outer inscription area is readily visible.

2. The tombstone/monument assembly as defined in claim 1 wherein each of said anchors is inserted in the ground and said enlarged member on each anchor is covered with fill to hold said anchor in the ground and thereby to secure said body on the ground.

3. The tombstone/monument assembly as defined in claim 2 wherein each said enlarged member is generally round and said connector extends orthogonally from said enlarged member.

4. The tombstone/monument assembly as defined in claim 1 further including a concrete slab, said connector projecting from said slab for connection to said body.

5. The tombstone/monument as defined in claim 1 further including a concrete slab having a plurality of apertures, each aperture adapted to be in registry with and to receive one of said anchor connectors, each connector extending through said slab with said bottom surface abutting one side of said slab and said enlarged member engaging the opposite side of said slab.

6. The tombstone/monument assembly as defined in claim 1 wherein each of said apertures is threaded for receipt of a threaded end of one of said anchors.

7. The tombstone/monument assembly as defined in claim 6 further including an internally threaded cylinder in each of said apertures, each cylinder adapted to receive a threaded end of one of said connectors.

8. The tombstone/monument assembly as defined in claim 1 wherein said body includes an upper, upright section having said inscription area; said base being enlarged and below said upright section for positioning adjacent the ground.

9. The tombstone/monument assembly as defined in claim 8 wherein said base includes perimeter corners, said apertures extending into said perimeter corners whereby said anchors are received therein.

10. The tombstone/monument as defined in claim 1 wherein said inscription area includes an inscription which is engraved directly therein, and said inscription area being on one wall of said tombstone/monument.

11. The tombstone/monument assembly of claim 1 including a roughened texture simulating natural cut granite on all surfaces except said inscription area and said bottom surface.

12. The tombstone/monument assembly of claim 11 wherein said moldable polymeric material is a polyester resin including a granite affect filler material providing the appearance of natural granite.

13. The tombstone/monument assembly of claim 12 wherein said granite affect filler material is a highlight particulate matter containing at least one of alumina trihydrate and calcium carbonate.

14. The tombstone/monument assembly of claim 11 wherein said moldable polymeric material is coated with gel coat for protection against the elements in outdoor environments.

15. The tombstone/monument assembly of claim 11 wherein said moldable polymeric material includes a reinforcing additive to increase strength selected from the group consisting of glass fibers, glass microbubbles, and polyurethane foam.

16. The tombstone/monument assembly of claim 11 wherein said inscription area includes raised indicia secured thereon, said indicia comprising individual letters, numbers, symbols or designs separately formed from said moldable polymeric material, each separate indicia including at least one securing member mounted to said inscription area.

17. The tombstone/monument assembly of claim 16 wherein said securing member is a post extending outwardly from said indicia; said inscription area including a hole receiving said post whereby said indicia are located in a predetermined position on said inscription area.

18. The tombstone/monument assembly of claim 17 including an adhesive between said indicia and said inscription area for bonding said indicia to said inscription area.

19. A molded tombstone/monument assembly comprising:

a one-piece, solid body constructed of a molded polymer, having an exterior top surface and a bottom surface, and defining a solid upright section extending upwardly from a solid base, said base having an outwardly extending perimeter defining an area larger than said upright section;

a plurality of apertures formed in said body bottom surface at intervals around said base adjacent said perimeter, said apertures opening downwardly and being concealed from view from said exterior;

a plurality of anchors assembled to said apertures in said body and adapted for burying in the ground using fill, each of said anchors including an enlarged member and a rod, said enlarged member being at one end of said rod and the other end of said rod being secured to one of said apertures in said base, wherein said enlarged member has a surface area substantially larger than said rod such that fill piled on top of said enlarged member will secure each of said anchors and said body to the ground.

20. The tombstone/monument assembly of claim 19 including a plurality of internally threaded cylinders, a respective one of said internally threaded cylinders positioned at each of said apertures and adapted to receive an anchor therein.

21. The molded tombstone as defined in claim 20, further including respective externally threaded anchoring rods attached to each of said cylinders.

22. The molded tombstone as defined in claim 21, further including a concrete slab, said anchoring rods engaging said concrete slab to secure said body on the ground.

23. A tombstone/monument comprising:

a one-piece, solid body formed from a moldable polymeric material, said body having a base portion and an upright display portion extending upwardly from said base portion; said display portion having an inscription area receiving at least one of engraved indicia formed in the surface of said inscription area and separately formed, raised indicia secured to said inscription area, said separately formed, raised indicia each including one securing member mounted to said inscription area; said base also having a bottom surface adapted to engage at least one of the ground and a support member set on the ground, at least one anchor with an enlarged area thereon secured to said bottom surface; said body having sufficient weight to maintain a desired, stable position on the ground or support member, said body including areas having a textured surface providing the appearance of natural cut stone.

24. The tombstone/monument of claim 23 wherein said inscription area is smooth for receipt of said indicia.

25. The tombstone/monument of claim 23 wherein said moldable polymeric material is a polyester resin including a granite affect filler material providing the appearance of natural granite.

26. The tombstone/monument of claim 25 wherein said granite affect filler material is a highlight particulate matter containing at least one of alumina trihydrate and calcium carbonate.

27. The tombstone/monument of claim 26 wherein said base has an outer perimeter defining an area larger than said upright display portion.

28. The tombstone/monument of claim 23 wherein said securing member is a post extending outwardly from said indicia; said inscription area including a hole receiving said post whereby said indicia are located in a predetermined position on said inscription area.

29. The tombstone/monument of claim 28 including an adhesive between said indicia and said inscription area for bonding said indicia to said inscription area.

* * * * *

UNITED STATES PATENT AND TRADEMARK OFFICE

CERTIFICATE OF CORRECTION

PATENT NO. : 5,595,029
DATED : January 21, 1997
INVENTOR(S) : Melvin H. Revoir and Gregory L. Revoir It is certified that error appears in the above-identified patent and that said Letters Patent is hereby corrected as shown below:

Column 4,
Line 8, “plan” should be -- plane --
Line 14, delete “the” in the second occurrence
Line 14, insert -- tombstone -- after “the”
Line 23, “ofyinvention” should be -- of the invention --
Line 35, “crete” should be -- concrete --

Column 6,
Line 21, “Controlled” should be -- controlled --
Line 44, “comer” should be -- corner --

Column 9,
Line 36, “from” should be -- front --

Signed and Sealed this

Eleventh Day of February, 2003

JAMES E. ROGAN
*Director of the United States Patent and Trademark Office*